US006237586B1

(12) United States Patent
Fontes

(10) Patent No.: US 6,237,586 B1
(45) Date of Patent: May 29, 2001

(54) HEATER TROUGH APPARATUS

(76) Inventor: Isalino S. Fontes, 381 W. Hawkeye Apt. K-1, Turlock, CA (US) 95380

( * ) Notice: Subject to any disclaimer, the term of this patent is extended or adjusted under 35 U.S.C. 154(b) by 0 days.

(21) Appl. No.: 09/489,563

(22) Filed: Jan. 21, 2000

(51) Int. Cl.[7] ..... F24H 1/00

(52) U.S. Cl. ..... 126/373.1; 126/376.1; 126/383.1; 126/374.1; 122/13.01; 122/14.22

(58) Field of Search ..... 126/373.1, 344, 126/364.1, 365.1, 374.1, 376.1, 380.1, 383.1, 38, 378.1, 377.1; 122/13.01, 13.3, 14.1, 14.2, 14.22, 355

(56) References Cited

U.S. PATENT DOCUMENTS

| | | | | |
|---|---|---|---|---|
| 1,121,340 | * | 12/1914 | Ellis | 126/373.1 |
| 1,273,560 | * | 7/1918 | Widhelm | 126/373.1 |
| 1,283,379 | * | 10/1918 | Walle | 126/373.1 |
| 1,389,050 | * | 8/1921 | Jarrett | 126/373.1 |
| 1,722,077 | * | 7/1929 | Dary | 126/373.1 |
| 2,590,117 | * | 3/1952 | Nordlund | 122/355 |
| 2,728,335 | * | 12/1955 | Garrett et al. | 126/373.1 |
| 3,651,796 | * | 3/1972 | Nelson | 126/38 |
| 3,964,465 | * | 6/1976 | Diggs | 126/373.1 |
| 5,103,801 | * | 4/1992 | Herring et al. | 126/374.1 |
| 5,575,272 | * | 11/1996 | Byrne | 126/374.1 |

* cited by examiner

*Primary Examiner*—Ira S. Lazarus
*Assistant Examiner*—Josiah C. Cocks

(57) ABSTRACT

A heater trough apparatus for heating water used for cleaning. The heater trough apparatus includes a tank mounted upon a plurality of leg members each having an adjustable feet member threaded through a bottom thereof, the tank having side walls, end walls, an upper floor, a lower floor, a main compartment and a secondary compartment each having a hole extending through the upper floor; and also includes an exhaust member having an exhaust port and an exhaust vent disposed between the upper and lower floors; and further includes a pipe member disposed between the floors and having one end connected to the hole in the main compartment and having another end connected to the hole in the secondary compartment; and also includes a housing which protects a thermostat, a pipe, a gas shut-off valve and a safety shut-off valve disposed in the pipe, a venturi pilot member at one of the ends of the pipe which is connected to a heat-producing burner which is disposed below the pipe member, and a switch for energizing the heat-producing burner; and further includes splash guards disposed below the housing and the tank; and also includes a mesh screen mounted about the tank for the protection thereof; and also includes a drain pipe for draining heated water from the main compartment.

15 Claims, 3 Drawing Sheets

HEATER TROUGH APPARATUS

BACKGROUND OF THE INVENTION

1. Field of the Invention

The present invention relates to water heated tank apparatus and more particularly pertains to a new heater trough apparatus for heating water used for cleaning.

2. Description of the Prior Art

The use of water heated tank apparatus is known in the prior art. More specifically, water heated tank apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,916,923; U.S. Pat. No. 5,325,548; U.S. Pat. No. 3,618,621; U.S. Pat. No. 2,915,072; U.S. Pat. No. 3,589,378; and U.S. Pat. No. Des. 364,253.

While these devices fulfill their respective, particular objectives and requirements, the aforementioned patents do not disclose a new heater trough apparatus. The inventive device includes a tank mounted upon a plurality of leg members each having an adjustable feet member threaded through a bottom thereof, the tank having side walls, end walls, an upper floor, a lower floor, a main compartment and a secondary compartment each having a hole extending through the upper floor; and also includes an exhaust member having an exhaust port and an exhaust vent disposed between the upper and lower floors; and further includes a pipe member disposed between the floors and having one end connected to the hole in the main compartment and having another end connected to the hole in the secondary compartment; and also includes a housing which protects a thermostat, a pipe, a gas shut-off valve and a safety shut-off valve disposed in the pipe, a venturi pilot member at one of the ends of the pipe which is connected to a heat-producing burner which is disposed below the pipe member, and a switch for energizing the heat-producing burner; and further includes splash guards disposed below the housing and the tank; and also includes a mesh screen mounted about the tank for the protection thereof; and also includes a drain pipe for draining heated water from the main compartment.

In these respects, the heater trough apparatus according to the present invention substantially departs from the conventional concepts and designs of the prior art, and in so doing provides an apparatus primarily developed for the purpose of heating water used for cleaning.

SUMMARY OF THE INVENTION

In view of the foregoing disadvantages inherent in the known types of water heated tank apparatus now present in the prior art, the present invention provides a new heater trough apparatus construction wherein the same can be utilized for heating water used for cleaning.

The general purpose of the present invention, which will be described subsequently in greater detail, is to provide a new heater trough apparatus apparatus and method which has many of the advantages of the water heated tank apparatus mentioned heretofore and many novel features that result in a new heater trough apparatus which is not anticipated, rendered obvious, suggested, or even implied by any of the prior art water heated tank apparatus, either alone or in any combination thereof.

To attain this, the present invention generally comprises a tank mounted upon a plurality of leg members each having an adjustable feet member threaded through a bottom thereof, the tank having side walls, end walls, an upper floor, a lower floor, a main compartment and a secondary compartment each having a hole extending through the upper floor; and also includes an exhaust member having an exhaust port and an exhaust vent disposed between the upper and lower floors; and further includes a pipe member disposed between the floors and having one end connected to the hole in the main compartment and having another end connected to the hole in the secondary compartment; and also includes a housing which protects a thermostat, a pipe, a gas shut-off valve and a safety shut-off valve disposed in the pipe, a venturi pilot member at one of the ends of the pipe which is connected to a heat-producing burner which is disposed below the pipe member, and a switch for energizing the heat-producing burner; and further includes splash guards disposed below the housing and the tank; and also includes a mesh screen mounted about the tank for the protection thereof; and also includes a drain pipe for draining heated water from the main compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heater trough apparatus apparatus and method which has many of the advantages of the water heated tank apparatus mentioned heretofore and many novel features that result in a new heater trough apparatus which is not anticipated, rendered obvious, suggested, or even implied by any of the prior art water heated tank apparatus, either alone or in any combination thereof.

It is another object of the present invention to provide a new heater trough apparatus which may be easily and efficiently manufactured and marketed.

It is a further object of the present invention to provide a new heater trough apparatus which is of a durable and reliable construction.

An even further object of the present invention is to provide a new heater trough apparatus which is susceptible of a low cost of manufacture with regard to both materials and labor, and which accordingly is then susceptible of low prices of sale to the consuming public, thereby making such heater trough apparatus economically available to the buying public.

Still yet another object of the present invention is to provide a new heater trough apparatus which provides in the apparatuses and methods of the prior art some of the advantages thereof, while simultaneously overcoming some of the disadvantages normally associated therewith.

Still another object of the present invention is to provide a new heater trough apparatus for heating water used for cleaning.

Yet another object of the present invention is to provide a new heater trough apparatus which includes a tank mounted upon a plurality of leg members each having an adjustable feet member threaded through a bottom thereof, the tank having side walls, end walls, an upper floor, a lower floor, a main compartment and a secondary compartment each having a hole extending through the upper floor; and also includes an exhaust member having an exhaust port and an exhaust vent disposed between the upper and lower floors; and further includes a pipe member disposed between the floors and having one end connected to the hole in the main compartment and having another end connected to the hole in the secondary compartment; and also includes a housing which protects a thermostat, a pipe, a gas shut-off valve and a safety shut-off valve disposed in the pipe, a venturi pilot member at one of the ends of the pipe which is connected to a heat-producing burner which is disposed below the pipe member, and a switch for energizing the heat-producing burner; and further includes splash guards disposed below the housing and the tank; and also includes a mesh screen mounted about the tank for the protection thereof; and also includes a drain pipe for draining heated water from the main compartment.

Still yet another object of the present invention is to provide a new heater trough apparatus that allows the user to recirculate and reheat water used to flush and clean a pipe network.

Even still another object of the present invention is to provide a new heater trough apparatus that vastly improves the level of cleanliness of pipe networks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
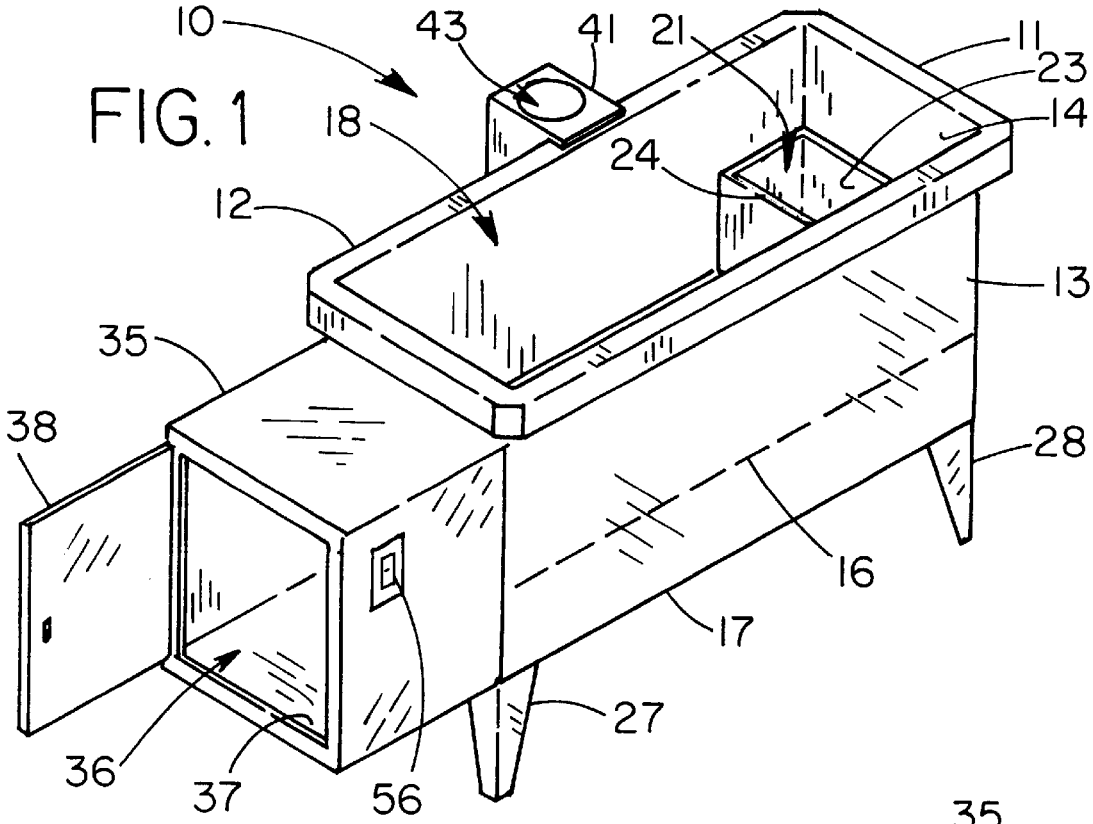
FIG. 1 is a top perspective view of a new heater trough apparatus according to the present invention.
Figure 2:
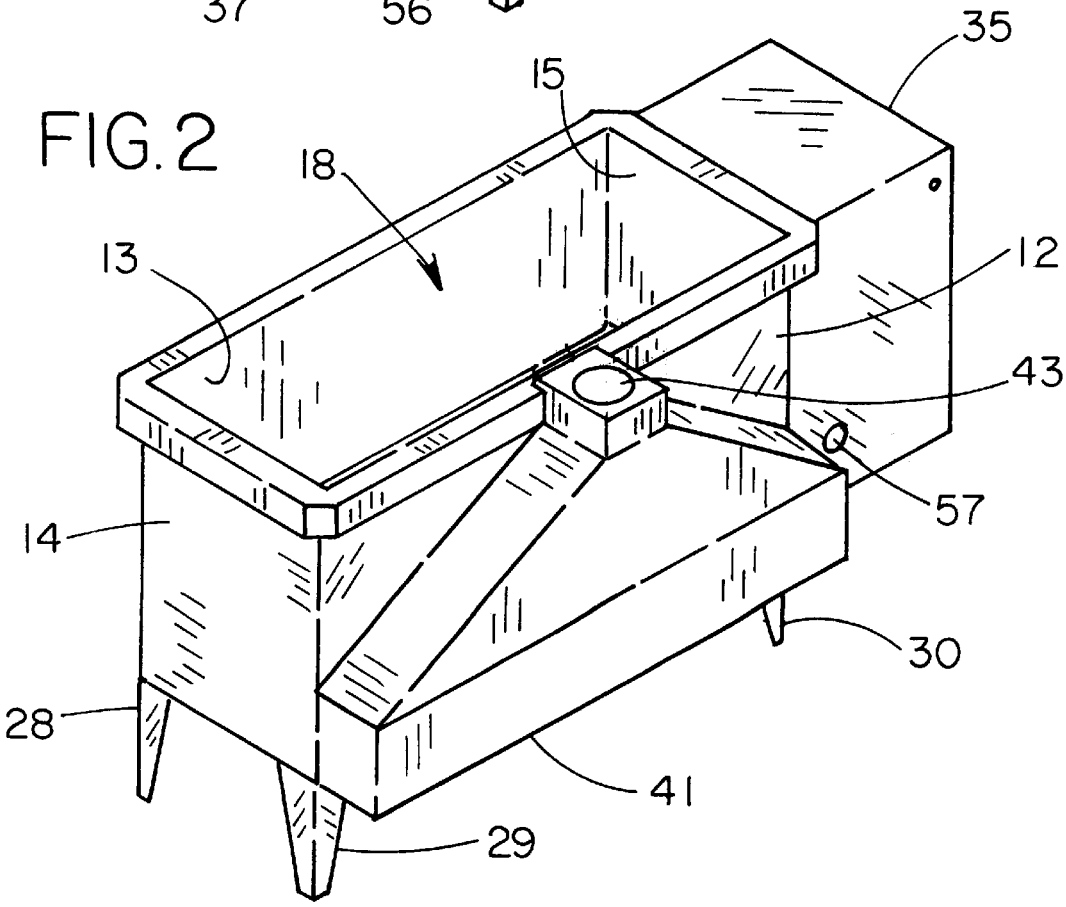
FIG. 2 is another top perspective view of the present invention.
Figure 3:
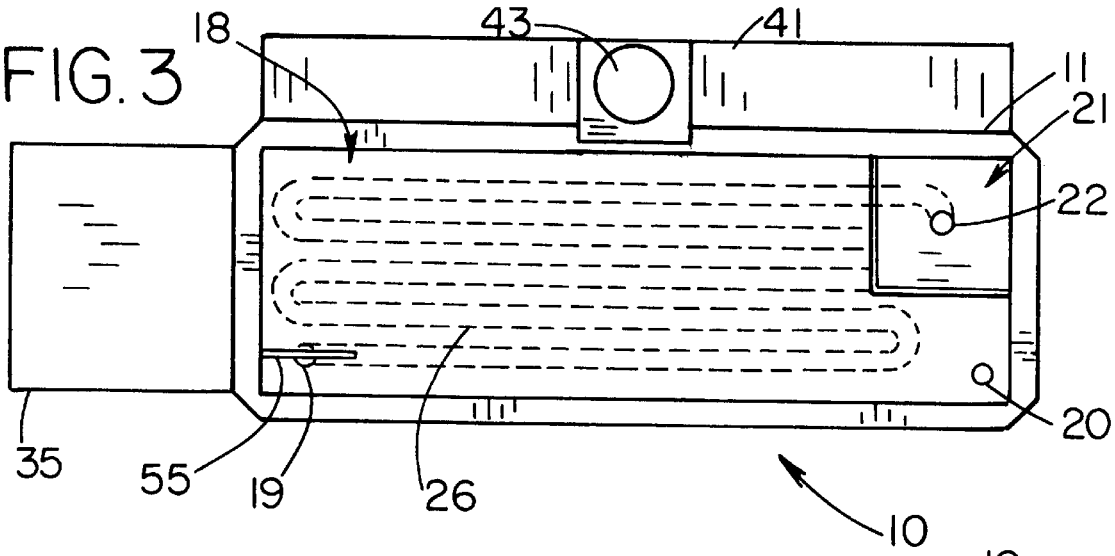
FIG. 3 is a top plan view of the present invention.
Figure 4:
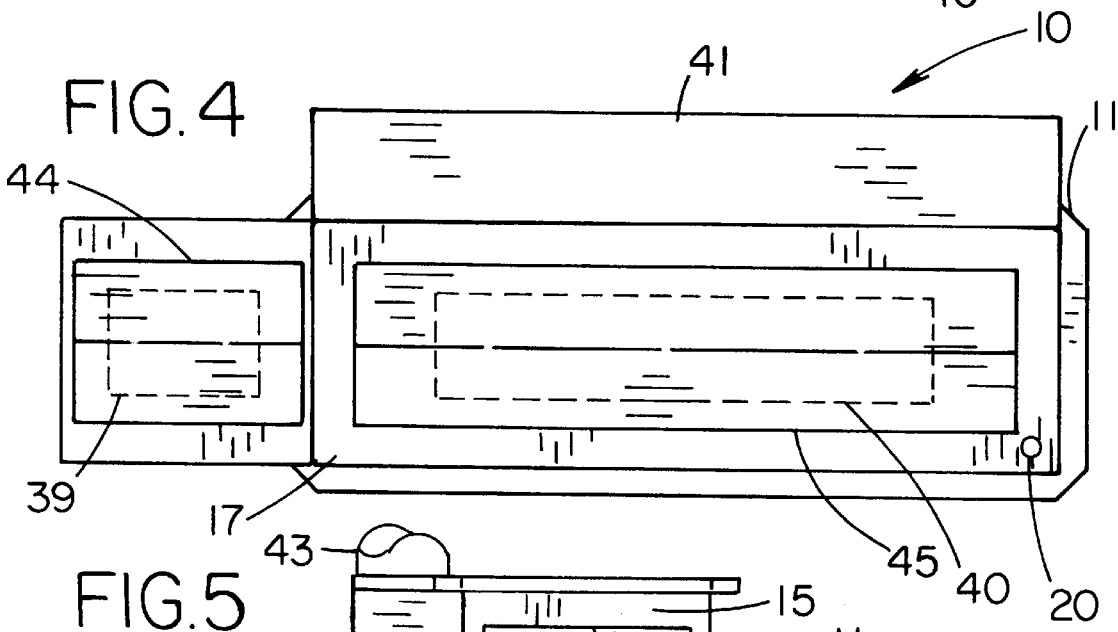
FIG. 4 is a bottom plan view of the present invention.
Figure 5:
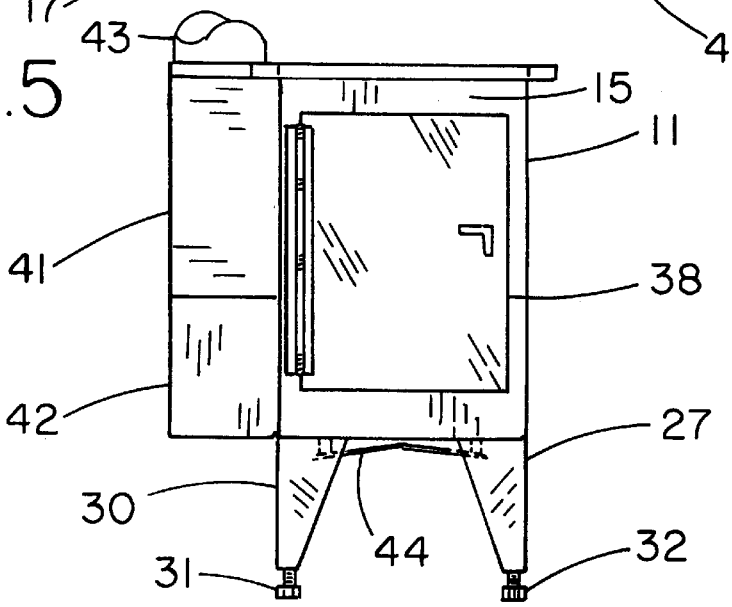
FIG. 5 is an end elevational view of the present invention.
Figure 6:
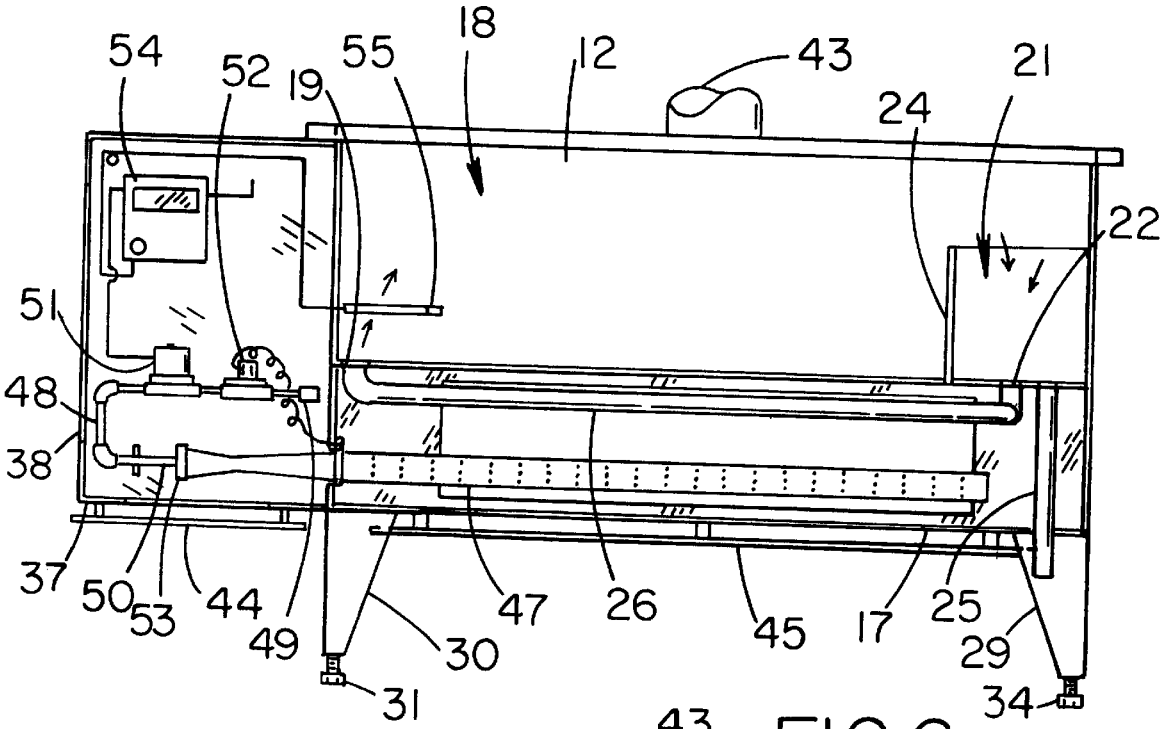
FIG. 6 is a side cross-sectional view of the present invention.
Figure 7:
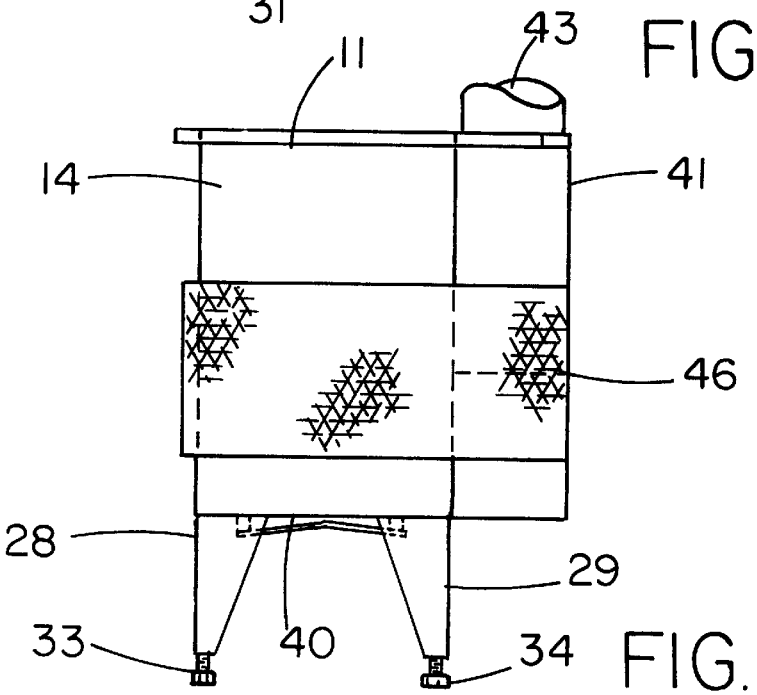
FIG. 7 is an end elevational view of the present invention.

With reference now to the drawings, and in particular to FIGS. 1 through 7 thereof, a new heater trough apparatus embodying the principles and concepts of the present invention and generally designated by the reference numeral 10 will be described.

As best illustrated in FIGS. 1 through 7, the heater trough apparatus 10 generally comprises a tank 11 having an upper floor 16, a lower floor 17, side walls 12,13, end walls 14,15, an open top, a main compartment 18 having a first hole 19 extending through the upper floor 16 and being adapted for holding heated water, and a secondary compartment 21 disposed inside the main compartment 18 and having side walls 23,24 and an open top and further having a second hole 22 extending through the upper floor 16 and being adapted for receiving cold water. The tank 11 further has a drain hole 20 extending through the upper floor 16. The lower floor 17 includes openings 40 extending therethrough for allowing air to enter between the lower floor 17 and the upper floor 16.

A pipe member 26 is securely and conventionally disposed below the upper floor 16 and having a first end conventionally connected to the first hole 19 and a second end conventionally connected to the second hole 22. The pipe member 26 serpentines back and forth below the upper floor 16 and is adapted to carry water from the secondary compartment 21 into the main compartment 18. A drain pipe 25 is conventionally connected to the drain hole 20 and extends below the bottom floor 17 for draining water from the main compartment 18. A plurality of leg members 27–30 are securely and conventionally attached to and depend from the lower floor 17 and including adjustable feet members 31–34 each of which is threaded through a bottom of a respective one of the leg members 27–30. A housing 35 is securely and conventionally attached to one of the end walls 15 of the tank 11 and has an open side 36 and a door 38 hingedly attached thereto and closeable over the open side 36. The housing 35 includes a bottom wall 38 which has openings 39 extending therethrough for allowing air to enter the housing 35;

An exhaust member 41 is securely and conventionally attached to one of the side walls 12 of the tank 11 and includes an exhaust port 43 extending outwardly from a top thereof and an exhaust vent 42 extending through the side wall 12 between the lower 17 and upper 16 floors;

A means for heating the pipe member 26 includes a pipe securely 48 and conventionally disposed in the housing 35 and having a first end 49 which is adapted to be connected to a fuel source and further has a second end 50. A heat-producing burner 47 is securely and conventionally disposed in the tank 11 below the pipe member 26 and is conventionally connected to the second end 50 of the pipe 48 for heating water flowing through the pipe member 26. A gas shut-off valve 51 is conventionally disposed in the pipe 48 intermediate of the first 49 and second 50 ends of the pipe 48. A safety shut-off valve 52 is conventionally disposed in the pipe 48 intermediate of the gas shut-off valve 51 and the first end 49 of the pipe 48. A thermostat 54 is securely and conventionally disposed in the housing 35 and is connected to the gas shut-off valve 51. A temperature sensor 55 is conventionally connected to the thermostat 54 and is disposed in the main compartment 18. A venturi pilot member 53 is conventionally disposed at the second end 50 of the pipe 48, and a switch 56 is conventionally mounted to the housing 35 and is connected to the thermostat 54 and is adapted to be connected to a power line for energizing the heat-producing burner 47. The housing 35 further includes a hole 57 extending through a side wall thereof. The first end 49 of the pipe 48 is conventionally disposed at the hole 57 which is adapted to receive a gas line. Splash guard members 44,45 are securely and conventionally disposed below and depend from the tank 11 and from the housing 35 for preventing water from entering through the openings 39,40 in the bottom wall 38 of the housing 35 and in the lower floor 17 of the tank 11. The splash guards 44,45 are plate-like members which are adapted to generally extend the length of the tank 11 and the housing 35. Each of the plate-like members has a longitudinal bend centrally disposed and extending a length thereof. A mesh screen 46 is securely and conventionally mounted to an exterior of the tank 11 for the protection thereof.

In use, the user turns on the heat-producing burner 47 by switching on the switch 56 which allows gas to pass through the pipe 48 and is ignited by the venturi pilot member 53. The user then puts cold water in the secondary compartment 21 which passes into the pipe member 26 which is heated by the heat-producing burner 47 before it passes into the main compartment 18 where the user can use the heated water for use in flushing and cleaning a dairy farm pipe network, in particular. Any water not used from the main compartment 18 is emptied through the drain pipe 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heater trough apparatus comprising:

a tank having an upper floor, a lower floor, side walls, end walls, an open top, a main compartment having a first hole extending through said upper floor, and a secondary compartment disposed inside said main compartment and having side walls and an open top and further having a second hole extending through said upper floor for receiving cold water, said tank further having a drain hole extending through said upper floor;

a pipe member securely disposed below said upper floor and having a first end connected to said first hole and a second end connected to said second hole;

a drain pipe connected to said drain hole and extending below said bottom floor;

a plurality of leg members securely attached to and depending from said lower floor and including adjustable feet members each of which is threaded through a bottom of a respective one of said leg members;

a housing securely attached to one of said end walls of said tank and having an open side and a door hingedly attached thereto and closeable over said open side;

an exhaust member securely attached to one of said side walls of said tank and including an exhaust port extending outwardly from a top thereof and an exhaust vent extending through said side wall between said lower and upper floors;

a means for heating said pipe member;

wherein said lower floor includes openings extending therethrough for allowing air to enter between said lower floor and said upper floor;

wherein said housing includes a bottom wall which has openings extending therethrough for allowing air to enter said housing; and splash guard members securely being disposed below and depending from said tank and from said housing for preventing water from entering through said openings in said bottom wall of said housing and in said lower floor of said tank.

2. A heater trough apparatus as described in claim 1, wherein said splash guards are plate-like members which are adapted to generally extend the length of said tank and said housing, each of said plate-like members has a longitudinal bend centrally disposed and extending a length thereof.

3. A heater trough apparatus as described in claim 1, wherein said pipe member serpentines back and forth below said upper floor.

4. A heater trough apparatus as described in claim 1, wherein said pipe member is adapted to carry water from said secondary compartment into said main compartment.

5. A heater trough apparatus as described in claim 1, wherein said means for heating said pipe member includes a pipe securely disposed in said housing and having a first end which is adapted to be connected to a fuel source and further having a second end; a heat-producing burner securely disposed in said tank below said pipe member and being connected to said second end of said pipe; a gas shut-off valve disposed in said pipe intermediate of said first and second ends of said pipe; a safety shut-off valve disposed in said pipe intermediate of said gas shut-off valve and said first end of said pipe; a thermostat securely disposed in said housing and connected to said gas shut-off valve; a temperature sensor connected to said thermostat and being disposed in said main compartment; a venturi pilot member disposed at said second end of said pipe for igniting gas from said pipe; and a switch mounted to said housing and connected to said thermostat and to a power line for energizing said heat-producing burner.

6. A heater trough apparatus as described in claim 1, wherein said housing further includes a hole extending through a side wall thereof, said first end of said pipe being disposed at said hole which is adapted to receive a gas line.

7. A heater trough apparatus as described in claim 1, further comprising a mesh screen securely mounted to an exterior of said tank for the protection thereof.

8. A heater trough apparatus comprising:

a tank having an upper floor, a lower floor, side walls, end walls, an open top, a main compartment having a first hole extending through said upper floor for holding heated water, and a secondary compartment disposed inside said main compartment and having side walls and an open top and further having a second hole extending through said upper floor for receiving cold water, said tank further having a drain hole extending through said upper floor, said lower floor including openings extending therethrough for allowing air to enter between said lower floor and said upper floor;

a pipe member securely disposed below said upper floor and having a first end connected to said first hole and a second end connected to said second hole, said pipe member serpentining back and forth below said upper floor, said pipe member being adapted to carry water from said secondary compartment into said main compartment;

a drain pipe connected to said drain hole and extending below said bottom floor;

a plurality of leg members securely attached to and depending from said lower floor and including adjustable feet members each of which is threaded through a bottom of a respective one of said leg members;

a housing securely attached to one of said end walls of said tank and having an open side and a door hingedly attached thereto and closeable over said open side, said housing including a bottom wall which has openings extending therethrough for allowing air to enter said housing;

an exhaust member securely attached to one of said side walls of said tank and including an exhaust port extending outwardly from a top thereof and an exhaust vent extending through said side wall between said lower and upper floors;

a means for heating said pipe member including a pipe securely disposed in said housing and having a first end which is adapted to be connected to a fuel source and further having a second end; a heat-producing burner securely disposed in said tank below said pipe member and being connected to said second end of said pipe for heating water flowing through said pipe member; a gas shut-off valve disposed in said pipe intermediate of said first and second ends of said pipe; a safety shut-off valve disposed in said pipe intermediate of said gas shut-off valve and said first end of said pipe; a thermostat securely disposed in said housing and connected to said gas shut-off valve; a temperature sensor connected to said thermostat and being disposed in said main compartment; a venturi pilot member disposed at said second end of said pipe for igniting gas from said pipe; and a switch mounted to said housing and connected to said thermostat and to a power line for energizing said heat-producing burner, said housing further including a hole extending through a side wall thereof, said first end of said pipe being disposed at said hole which is adapted to receive a gas line;

splash guard members being securely disposed below and depending from said tank and from said housing for preventing water from entering through said openings in said bottom wall of said housing and in said lower floor of said tank, said splash guards being plate-like members which are adapted to generally extend the length of said tank and said housing, each of said plate-like members having a longitudinal bend centrally disposed and extending a length thereof; and a mesh screen being securely mounted to an exterior of said tank for the protection thereof.

9. A heater trough apparatus comprising:

a tank having an upper floor, a lower floor, side walls, end walls, an open top, a main compartment having a first hole extending through said upper floor, and a secondary compartment disposed inside said main compartment and having side walls and an open top and further having a second hole extending through said upper floor for receiving cold water, said tank further having a drain hole extending through said upper floor;

a pipe member securely disposed below said upper floor and having a first end connected to said first hole and a second end connected to said second hole;

a housing securely attached to one of said end walls of said tank and having an open side and a door hingedly attached thereto and closeable over said open side;

an exhaust member securely attached to one of said side walls of said tank and including an exhaust port extending outwardly from a top thereof and an exhaust vent extending through said side wall between said lower and upper floors;

a means for heating said pipe member;

wherein said lower floor includes openings extending therethrough for allowing air to enter between said lower floor and said upper floor;

wherein said housing includes a bottom wall which has openings extending therethrough for allowing air to enter said housing; and splash guard members securely being disposed below and depending from said tank and from said housing for preventing water from entering through said openings in said bottom wall of said housing and in said lower floor of said tank.

10. A heater trough apparatus as described in claim 9, wherein said splash guards are plate-like members which are adapted to generally extend the length of said tank and said housing, each of said plate-like members has a longitudinal bend centrally disposed and extending a length thereof.

11. A heater trough apparatus as described in claim 9, wherein said pipe member serpentines back and forth below said upper floor.

12. A heater trough apparatus as described in claim 9, wherein said pipe member is adapted to carry water from said secondary compartment into said main compartment.

13. A heater trough apparatus as described in claim 9, wherein said means for heating said pipe member includes a pipe securely disposed in said housing and having a first end which is adapted to be connected to a fuel source and further having a second end; a heat-producing burner securely disposed in said tank below said pipe member and being connected to said second end of said pipe; a gas shut-off valve disposed in said pipe intermediate of said first and second ends of said pipe; a safety shut-off valve disposed in said pipe intermediate of said gas shut-off valve and said first end of said pipe; a thermostat securely disposed in said housing and connected to said gas shut-off valve; a temperature sensor connected to said thermostat and being disposed in said main compartment; a venturi pilot member disposed at said second end of said pipe for igniting gas from said pipe; and a switch mounted to said housing and connected to said thermostat and to a power line for energizing said heat-producing burner.

14. A heater trough apparatus as described in claim 9, wherein said housing further includes a hole extending through a side wall thereof, said first end of said pipe being disposed at said hole which is adapted to receive a gas line.

15. A heater trough apparatus as described in claim 9, further comprising a mesh screen securely mounted to an exterior of said tank for the protection thereof.

* * * * *